US009810059B2

(12) United States Patent
Ahmad

(10) Patent No.: US 9,810,059 B2
(45) Date of Patent: Nov. 7, 2017

(54) WIRELESS POWER TRANSMISSION TO DOWNHOLE WELL EQUIPMENT

(71) Applicant: Saudi Arabian Oil Company, Dhahran (SA)

(72) Inventor: Talha Jamal Ahmad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 30 days.

(21) Appl. No.: 14/735,227

(22) Filed: Jun. 10, 2015

(65) Prior Publication Data

US 2015/0377016 A1 Dec. 31, 2015

Related U.S. Application Data

(60) Provisional application No. 62/018,749, filed on Jun. 30, 2014.

(51) Int. Cl.

| | |
|---|---|
| ***G01V 3/00*** | (2006.01) |
| ***E21B 47/16*** | (2006.01) |
| ***E21B 41/00*** | (2006.01) |

(52) U.S. Cl.

CPC ..... *E21B 47/16* (2013.01); *E21B 41/0085* (2013.01)

(58) Field of Classification Search

CPC ..... E21B 47/16; E21B 41/0085

USPC ..... 340/855.8

See application file for complete search history.

(56) References Cited

U.S. PATENT DOCUMENTS

| | | | | |
|---|---|---|---|---|
| 4,072,044 A * | 2/1978 | Farwell | ..... | G01N 33/24 73/291 |
| 4,215,426 A | 7/1980 | Klatt | | |
| 4,839,644 A | 6/1989 | Safinya et al. | | |
| 5,744,877 A | 4/1998 | Owens | | |

(Continued)

FOREIGN PATENT DOCUMENTS

| | | |
|---|---|---|
| EP | 0295178 A2 | 12/1968 |
| EP | 0721053 A1 | 7/1996 |

(Continued)

OTHER PUBLICATIONS

International Search Report and Written Opinion for related PCT application PCT/US2015/038521 dated Oct. 12, 2015.

(Continued)

*Primary Examiner* — Tanmay Shah

(74) *Attorney, Agent, or Firm* — Bracewell LLP; Constance G. Rhebergen; Albert B. Kimball, Jr.

(57) ABSTRACT

Wireless power transmission to downhole well installations is provided using acoustic guided Lamb waves and a tubular conduit (production tubing, casing) as the power transmission medium. A phased array of acoustic transmitters is present at the transmitting end (surface) and an array of acoustic receivers at the receiving end (downhole). Both transmitter and receiver arrays are coupled to the tubular conduit. Beamforming techniques are used along with power amplifiers to generate directional, high power and low frequency acoustic guided Lamb waves along the wellbore to transmit power over long distances. A downhole multi-channel acoustic energy collecting system receives the transmitted acoustic signal, and generates electrical power and stores the power in downhole electrical power storage. This power is used to operate downhole well equipment including sensing, control and telemetry devices.

28 Claims, 7 Drawing Sheets

(56) References Cited

U.S. PATENT DOCUMENTS

| | | | | |
|---|---|---|---|---|
| 6,415,869 | B1 | 7/2002 | Smith | |
| 6,515,592 | B1 | 2/2003 | Babour et al. | |
| 7,114,561 | B2 | 10/2006 | Vinegar et al. | |
| 7,488,194 | B2 | 2/2009 | Hall et al. | |
| 8,009,059 | B2 | 8/2011 | Huang et al. | |
| 8,353,336 | B2 | 1/2013 | Neuhaus et al. | |
| 8,358,220 | B2 | 1/2013 | Savage | |
| 2003/0058127 | A1 | 3/2003 | Babour et al. | |
| 2006/0016606 | A1* | 1/2006 | Tubel | E21B 41/0085 166/386 |
| 2007/0194947 | A1* | 8/2007 | Huang | E21B 47/14 340/854.3 |

FOREIGN PATENT DOCUMENTS

| | | | |
|---|---|---|---|
| EP | 1918508 | A1 | 5/2008 |
| WO | 02/063341 | A1 | 8/2002 |
| WO | 03/046333 | A3 | 6/2003 |
| WO | 2008/148613 | A2 | 12/2008 |
| WO | 2011/087400 | A1 | 7/2011 |
| WO | 01/55555 | A1 | 8/2011 |
| WO | 2014035785 | A1 | 3/2014 |

OTHER PUBLICATIONS

Horowitz, P. et al. The Art of Electronics, Cambridge University Press. 1989, pp. 343-349. ISBN 978-0-521-37095-0.

http://www.twi.co.uk/news-events/bulletin/archive/2008/november-december/corrosion-detection-in-offshore-risersusing-guided-ultrasonic-waves/.

Kazmierkowski, M.P.; et al., "Contactless energy transfer (CET) systems—A review," Power Electronics and Motion Control Conference (EPE/PEMC), Sep. 2012.

Lomonova, E. et al. "Acoustic Energy Transfer: A Review", IEEE Transactions on Industrial Electronics, vol. 60, No. 1, 2013.

Mandal, S.; et al, "Low-Power CMOS Rectifier Design for RFID Applications," Circuits and Systems I: Regular Papers, IEEE Transactions on , vol. 54, No. 6, pp. 1177,1188, Jun. 2007.

Waffenschmidt, et al., "Limitation of inductive power transfer for consumer application," in Proc. European Conf. Power Electronics and Applications, vol. 1, Sep. 2009, pp. 1-10.

Williams; J. et al, "High Efficiency Linear Regulators", Mar. 1, 1989.

Xuanchao, Lui; et al, "Research on Downhole Wireless Remote Monitoring and Information Transmission Technology," Education Technology and Computer Science (ETCS), 2010 Second International Workshop on , vol. 3, No., pp. 756,759, Mar. 6-7, 2010.

* cited by examiner

WIRELESS POWER TRANSMISSION TO DOWNHOLE WELL EQUIPMENT

This application claims priority from U.S. Provisional Application No. 62/018,749, filed Jun. 30, 2014. For purposes of United States patent practice, this application incorporates the contents of the Provisional Application by reference in entirety.

BACKGROUND OF THE INVENTION

1. Field of the Invention

The present invention relates to wireless power transmission in oil wells to downhole well equipment, using guided acoustic Lamb waves and with tubular conduits in the well serving as a power transmission medium.

2. Description of the Related Art

Reservoir management has been based on acquiring reservoir data captured by permanently installed sensors inside a well. These sensors were directly in contact with the reservoir to be monitored and provided real-time data concerning reservoir conditions for long-term and continuous reservoir management. One such reservoir management system is a permanent downhole monitoring system, or PDHMS, utilized by the assignee of the present application in what were referred to as smart wells.

Downhole permanent installations included both sensors and control valves. The sensors were used to monitor various physical and dynamical properties of the well, including temperature, pressure, and multiphase flow rates. In the case of smart wells, the sensors were combined with flow control devices to adjust fluid flow rate and optimize well performance and reservoir behavior. Electrical power was required to be provided to both sensors and flow control devices.

Other permanently deployed or installed downhole wellbore instrumentation applications where operating electrical power was required included sensors (geophones) for monitoring seismic or acoustic earth properties, formation pressure sensors, optical sensors, and electromagnetic field or EM sensors.

Usually these permanently deployed systems relied on cables run from surface to provide power to these devices. With these devices installed at depths of several thousands of feet inside a well, the use of cable was very expensive, as well as being and time-consuming to install. The use of cable was thus undesirable. Cable was also difficult to use in a wellbore along the tubing string whether integral to the well tubing or spaced in the annulus between well tubing and casing. Other disadvantages of using cables included reliability issues, complicated installation, and the risk of cable breaking because of the corrosion from well fluids, as well as heavy wear due to movement of the tubing string within the wellbore. A number of techniques have been proposed to eliminate cables and the associated problems to provide wireless transmission of power inside a well from the surface using a tubular conduit (production tubing or casing) as transmission medium.

Electromagnetic based power transmission methods allowed for an electrical signal to be injected into electrically conductive casings or tubing to create an electrical dipole source at the bottom of the well. U.S. Pat. No. 4,839,644 involved a tubing-casing electrical conduction transmission system in which an insulated system of tubing and casing served as a coaxial line to transmit both power and data. The system used an inductive coupling technique and a toroid was used for current injection. This required a substantially nonconductive fluid such as crude oil in the annulus between casing and tubing.

In U.S. Published Patent Application No. 2003/0058127 an electrically insulated conductive casing was used to establish electrical connection between surface and permanent downhole installations. Current was caused to flow to power downhole installations. U.S. Pat. No. 6,515,592 also used an electrically conductive conduit in the well with electrical insulation of a section of the conduit and insulation of the encapsulated section of conduit from an adjoining section by a conduit gap. The downhole device was coupled to insulated section and both power and data is transmitted. U.S. Pat. No. 7,114,561 used metal well casing for a power and data communication path between surface and downhole modules, with formation ground used as the return path to complete the electrical circuit.

U.S. Pat. No. 8,009,059 involved a downhole sensor energized with a surface pressure wave generator and a downhole mechanical to electrical energy converter. The energy converter took the form of magnetostrictive material or a piezoelectric crystal. U.S. Pat. No. 8,358,220 described a wellbore communication system using casing or tubing as transmission medium and employing electromagnetic coupling based technique.

Fiber optical cable and a solar cell were arranged inside a well in European Patent No. 1918508. Solar light was transmitted through the fiber optical cable in the wellbore such that the transmitted light illuminated a solar cell and the solar cell generated electricity for use by downhole well equipment. European Patent No. 1448867 discloses downhole power generators, which convert hydraulic energy into electrical energy.

Other methods for power transmission inside a well are described in European Patent No. 0721053; U.S. Pat. No. 6,415,869; European Patent No. 1252416; PCT Published Application WO 2002063341; European Patent No. 2153008; U.S. Pat. No. 7,488,194; U.S. Pat. No. 8,353,336; U.S. Pat. No. 5,744,877; and PCT Published Application WO 2011087400.

The methods which employed a toroid for current injection in casing, tubing, or a drill string were limited in the amount of power which could be inductively coupled. Also, the current loop would be local, as the current sought the shortest path that is through the casing. Another disadvantage of prior systems was that the wellhead necessarily had to be maintained at a very high electrical potential in order to achieve the desired current density at well bottom. Thus, so far as is known, the prior art had limitations including high operational and design complexity, limited power transfer, low or short transmission distance and low transmission efficiency.

SUMMARY OF THE INVENTION

Briefly, the present invention provides a new and improved apparatus for wireless transmission of power through well tubing to downhole electrical equipment mounted with the well tubing in a wellbore. The apparatus includes a transducer module which converts electrical power to guided wave energy while mounted with the well tubing for transfer of the guided wave energy to the well tubing for downhole travel through walls of the well tubing. The apparatus also includes a motion sensing module mounted with the well tubing in the wellbore at a depth in the wellbore of the electrical equipment and sensing the guided wave energy in walls of the well tubing, and a power converter mounted with the well tubing in the wellbore at the depth in the wellbore of the electrical equipment converting the sensed guided wave energy to electrical energy. The apparatus also includes an electrical power storage unit mounted with the well tubing at the depth in the wellbore of the electrical equipment to store electrical energy converted from the sensed guided wave energy.

The present invention provides a new and improved method of wireless transmission of power through well tubing to downhole electrical equipment mounted with the well tubing in a wellbore. With the present invention, electrical power is converted to guided wave energy at a wellhead adjacent the wellbore and the guided wave energy transferred to the well tubing. The guided wave energy is conducted through walls of the well tubing to the downhole electrical equipment. The guided wave energy in the well tubing is sensed at a depth in the wellbore of the electrical equipment, and converted electrical energy. The electrical energy converted from the sensed guided wave energy is stored for use as operating power by the downhole electrical equipment.

DETAILED DESCRIPTION OF THE PREFERRED EMBODIMENTS

Figure 1:
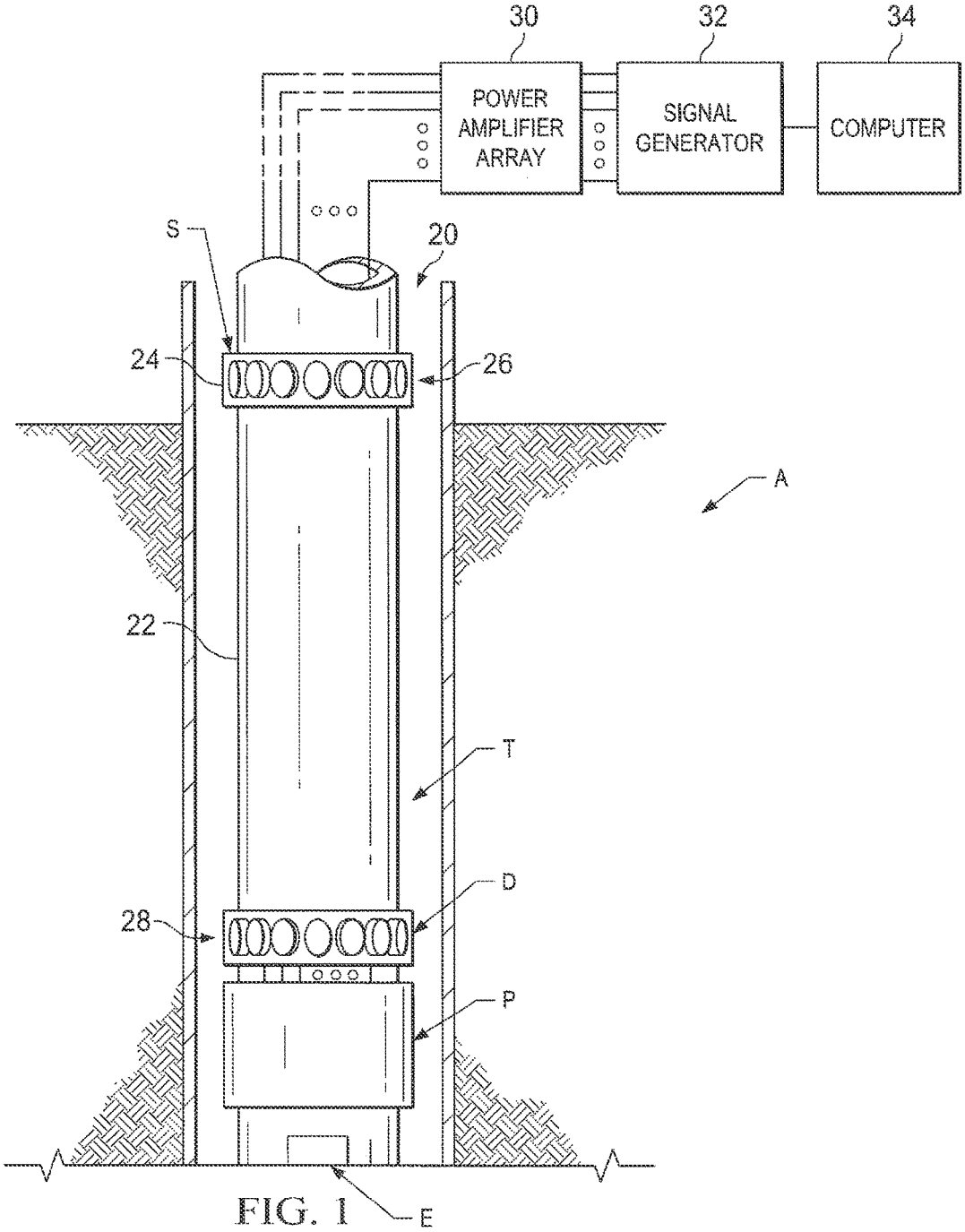
FIG. 1 is a schematic diagram of a wireless power transmission to downhole well equipment apparatus according to the present invention disposed in a well borehole.

In the drawings, the letter A designates generally an apparatus according to the present invention for wireless power transmission to downhole well equipment. The apparatus A transmits acoustic guided Lamb waves are used to transfer power inside a well using production tubing or other conduit T, which may be well casing or drill string, as the transmission medium for transfer of operating power to downhole equipment E shown schematically in a wellbore 20. The downhole well equipment E may take the form of sensors located in the wellbore 20 or mounted on the tubing T. The sensors acquire real-time data from reservoir formations of interest adjacent the wellbore 20 for continuous or automated reservoir management. The downhole well equipment E may also take the form of electromechanical flow control mechanisms such as valves to adjust fluid flow in wellbore 20.

The apparatus A includes a surface transducer module S which has a mounting frame or collar 24 containing an array of acoustic transmitter transducers 26 which convert electrical power generated at the surface to guided vibratory wave energy. The surface transducer module S is mounted by the frame or collar 24 with the well tubing T for transfer of the guided wave energy, and the guided wave energy travels downhole through a cylindrical wall 22 of the well tubing T. A downhole motion sensing module D is mounted with the well tubing T in the wellbore 20 at a depth of interest in the wellbore 20 where downhole well equipment E is located. The downhole motion sensing module D sensing the guided wave energy in walls of the well tubing includes an acoustic receiver transducer array R including a mounting frame 27 or collar containing an array of acoustic receiver transducers 28 which forms electrical signals in response to the sensed guided wave energy in the wall of well tubing T.

A power converter P is mounted with the well tubing T in the wellbore 22 at the depth of the downhole well equipment E and converts the sensed guided wave energy to electrical energy. An electrical power/energy storage unit S is mounted with the well tubing T at the depth in the wellbore of the electrical equipment to store electrical energy converted by the power converter P from the sensed guided wave energy.

With the present invention, the guided wave energy takes the form of guided elastic or acoustic vibratory waves known as Lamb waves. Lamb waves are similar to longitudinal waves, with compression and rarefaction, but they are bounded by the cylindrical walls or inner and outer sheet or pipe surfaces of the tubing T, causing a wave-guide type effect. The vibratory energy of the lamb waves is in the form of elastic motion energy which travels as particle motion in the cylindrical walls of tubular conduit T in a vertical plane parallel with the longitudinal axis of the conduit T. The guided wave energy of such Lamb waves is guided because of the geometry and dimensions of the tubular conduit of the casing or production tubing T.

In a tubing type structure with the present invention, acoustic Lamb waves become trapped if their wavelength is significant in comparison to the tubing dimensions. Due to continuous reflections at the boundaries they form wave packets that can propagate over very long distances. The shape of the wave packet defines the wave mode and different wave modes have different propagation properties. The advantage of guided waves is that they can propagate long distances.

Figure 2:
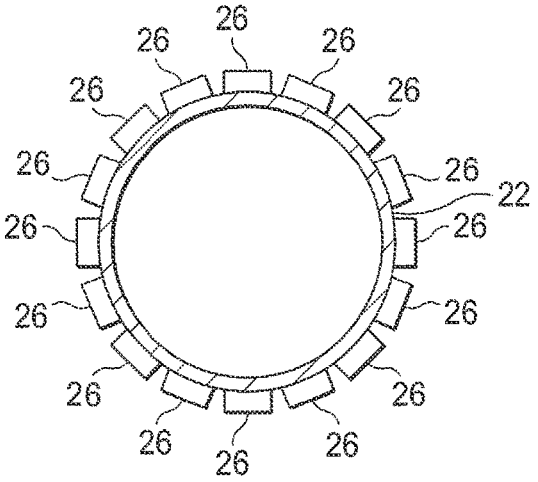
FIG. 2 is a cross-sectional view taken along the lines 2-2 of FIG. 1.

The surface transducer module S is formed by a phased array of acoustic transmitters 26 (FIG. 2) at the transmitting end (surface) and the downhole motion sensing module D is composed of an array of acoustic receivers 28 at receiving end (downhole). The acoustic transducer arrays in modules S and D are formed by a large number of transducers (from 8 to 64, for example) which are coupled to the tubular conduit T, which may be tubing, casing or drill string, as mentioned. The number of transducers in the modules S and D utilized may vary depending upon the dimensions of tubular conduit T, the dimensions of the acoustic transducers and the amount of power to be transferred.

Each of the transducers in the arrays S and D is clamped at a circumferentially spaced position from others in its array in its mounting frame or collar in a common plane (FIG. 2) transverse the longitudinal axis of the tubular conduit 20. The mounting frame 24 is not shown in FIG. 2 in order that the transducers may be shown schematically. The acoustic transmitter transducers 26 are also preferably mounted on the tubular conduit T at an angle of 0-20° inclined toward the transmission direction so that the acoustic guided Lamb wave signals can travel in a single direction through the walls of the conduit T along the wellbore 20 in the downward direction.

The acoustic transducers 26 and 28 can be made, for example, of what is known as giant magnetostrictive material (GMM) instead of piezoelectric material. The stretching factor of a giant magnetostrictive material is from about 5 to about 8 times and energy density is about 10 to about 14 times greater that of a piezoelectric material. Also, the operating frequency range of a giant magnetostrictive material is wide and its working temperature can more than 200° C. Further information about giant magnetostrictive materials is contained, for example, F. Claeyssen, N. Lhermet, R. Le Letty, P. Bouchilloux, "Actuators, Transducers and Motors Based on Giant Magnetostrictive Materials," Journal of Alloys and Compounds, Vol. 258, pp. 61-73, August 1997.

The uphole acoustic transmitter transducers 26 convert the energy contained in input electric signal into acoustic guided Lamb waves. As will be described, a beamforming technique is used at transmitting module S to send directional, high power and low frequency acoustic guided Lamb wave signals along the tubular conduit T into the wellbore 20. The operating frequency of acoustic transducers may, for example, be from about 100 to about 5000 Hz.

The acoustic transmitter transducers 26 in the phased array of surface transducer module S (FIG. 1) at the transmitting end (or surface) are each driven by a high voltage power amplifier in a power amplifier array 30. The power amplifiers in array 30 convert the low amplitude signal generator output (5 Vpp) to a very-high amplitude driving voltage (200-1000 Vpp) required for acoustic transmitter transducers 26. A class E power amplifier can be used for this purpose, for example.

The power amplifiers in the array 30 are connected to a signal generator 32 which is controlled by a computer 34, which may be a programmed personal computer (PC) or a field-programmable gate array or FPGA. The computer 34 controls the signal generator 32 and uses a beam forming technique to generate a highly directional, high power and guided acoustic Lamb wave signal along the conduit T. The power amplifiers in the array 30 convert a low voltage signal from signal generator 32 to a high-voltage, high-current signal to drive the acoustic transmitter transducers 26. The total power delivered is in the range of 50-500 watts for each of the transducers. The signal generator 32 generates a low voltage square wave excitation signal with a frequency in conformance with the frequency range of acoustic transmitters described above.

The guided acoustic Lamb wave signal after downward travel through the walls of conduit T in the wellbore 20 is received at the downhole motion sensing module D by an array of acoustic receiver transducers 28, which are coupled with the tubular conduit T. The receiver array of transducers 28 is located closely adjacent to the downhole equipment E to be powered. The acoustic receiver array of transducers 28 is connected to the power converter P which is configured to operate as an energy harvesting system. The power converter P serves as a downhole power conditioning and provides power to be stored in the downhole power storage unit S.

Figure 4:
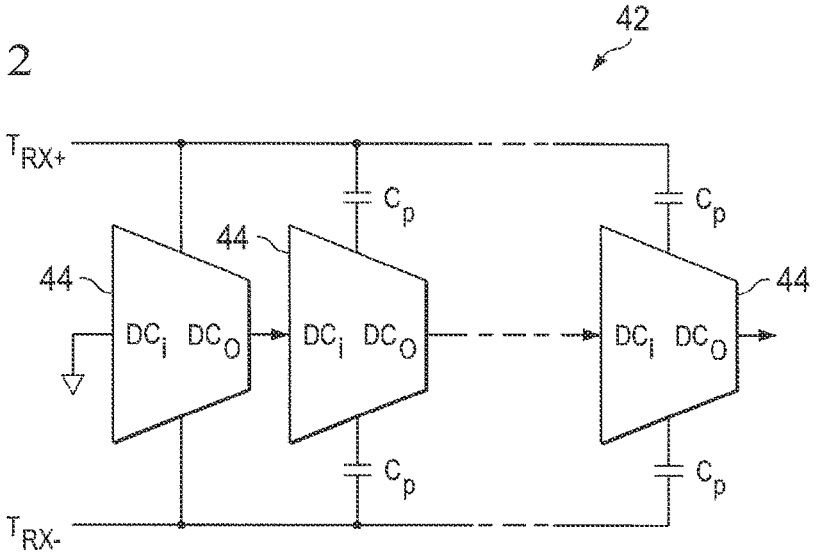
FIG. 4 is a schematic electrical circuit diagram of a portion of the apparatus of FIG. 3.
Figure 5:
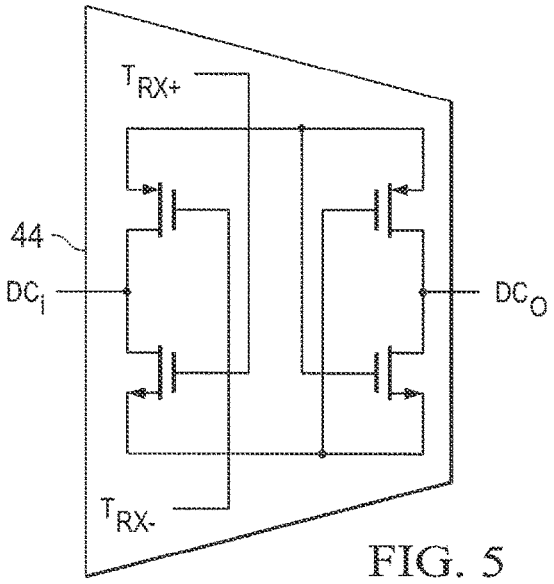
FIG. 5 is a schematic electrical circuit diagram of a portion of the apparatus of FIG. 3.
Figure 3:
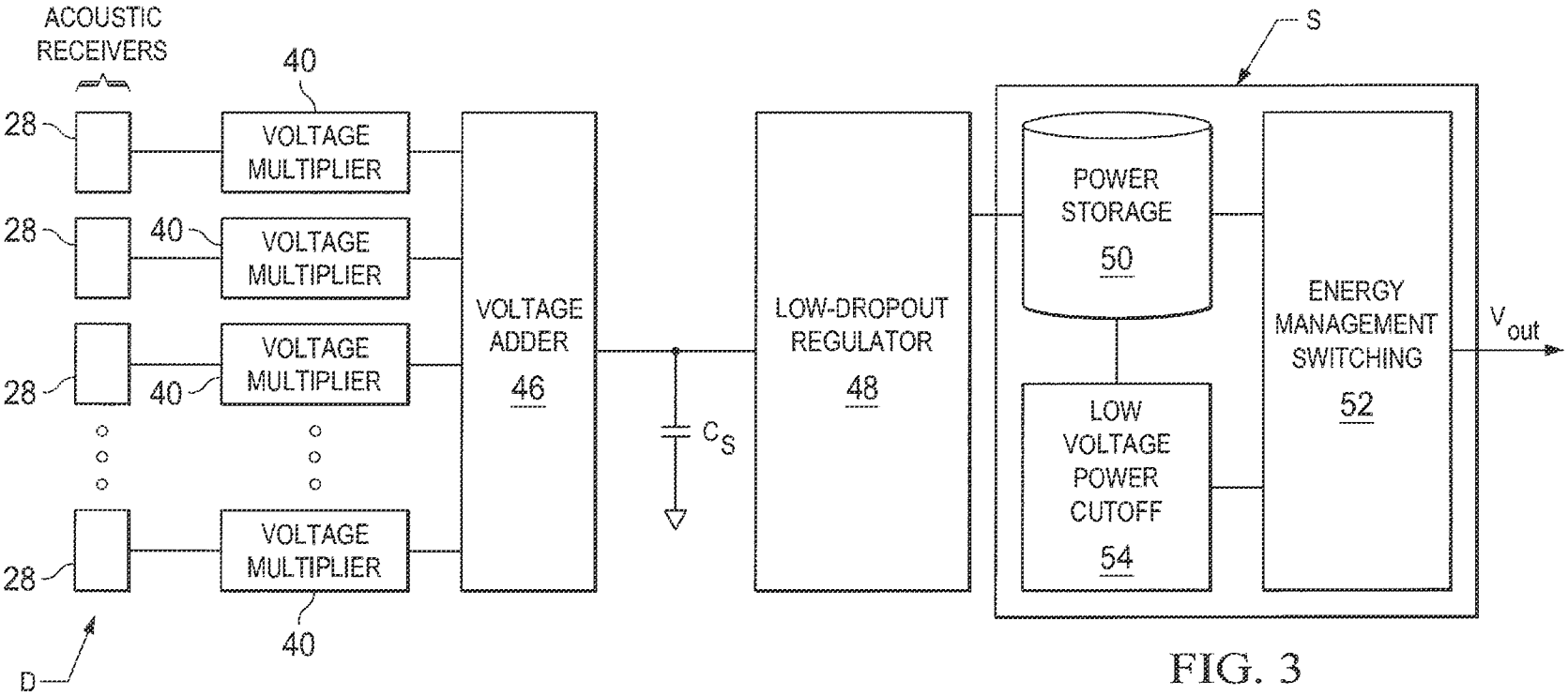
FIG. 3 is a schematic electrical circuit diagram of a wireless power transmission to downhole well equipment apparatus according to the present invention.

Each of the acoustic receiver transducers 28 in the downhole motion sensing module D receives a portion of the guided acoustic Lamb wave signal. The amount of received signal varies non-linearly with each receiver transducer 28. The amplitude of received signal depends on transmission distance, structural geometry and dimensions of tubular conduit T, and presence of any metallic tools and completion hardware. The receiver transducers 28 convert the received acoustic Lamb wave signal into an electrical signal. The electrical signal is a very low amplitude alternating voltage (AC) signal which is furnished to an associated voltage multiplier 40 (FIG. 3). With the present invention, a number of conventional types of voltage multiplier/rectifier 40 may be used to convert AC voltage to DC. One example is a multistage synchronous voltage multiplier 42 (FIG. 4) to convert AC to DC voltage. The multistage synchronous voltage multiplier 42 is composed of a suitable number of individual multiplier stages 44 of a power conditioning circuit R which transforms the DC voltage to a form more suitable for storage in downhole power storage unit S. The number of stages 44 can vary, typically from 3 to 5. A suitable multiplier stage may take the form of a low-voltage CMOS (complementary metal-oxide-semiconductor) rectifier of the type described, for example, in Mandal, S.; Sarpeshkar, R., "Low-Power CMOS Rectifier Design for RFID Applications," Circuits and Systems 1: Regular Papers, IEEE Transactions on, Vol. 54, No. 6, pp. 1177, 1188, June 2007. Circuit details of the voltage multiplier stages 44 are provided in FIG. 5.

The CMOS rectifier 44 is chosen from those capable of operation with very low input voltage amplitude. In situations encountered according to the present invention, the input amplitude is very low, and a single stage 42 usually does not provide high enough DC output voltage. A number of stages 42 are accordingly cascaded in a charge-pump like topology to increase output DC voltage.

The outputs from receiver transducers 28 are fed from multipliers 40 in parallel into each rectifier stage 42 through pump capacitors $C_p$ (FIG. 3), and the DC outputs add up in series in a voltage adder 46 to produce a summed output DC voltage from the multipliers 42.

Figure 11:
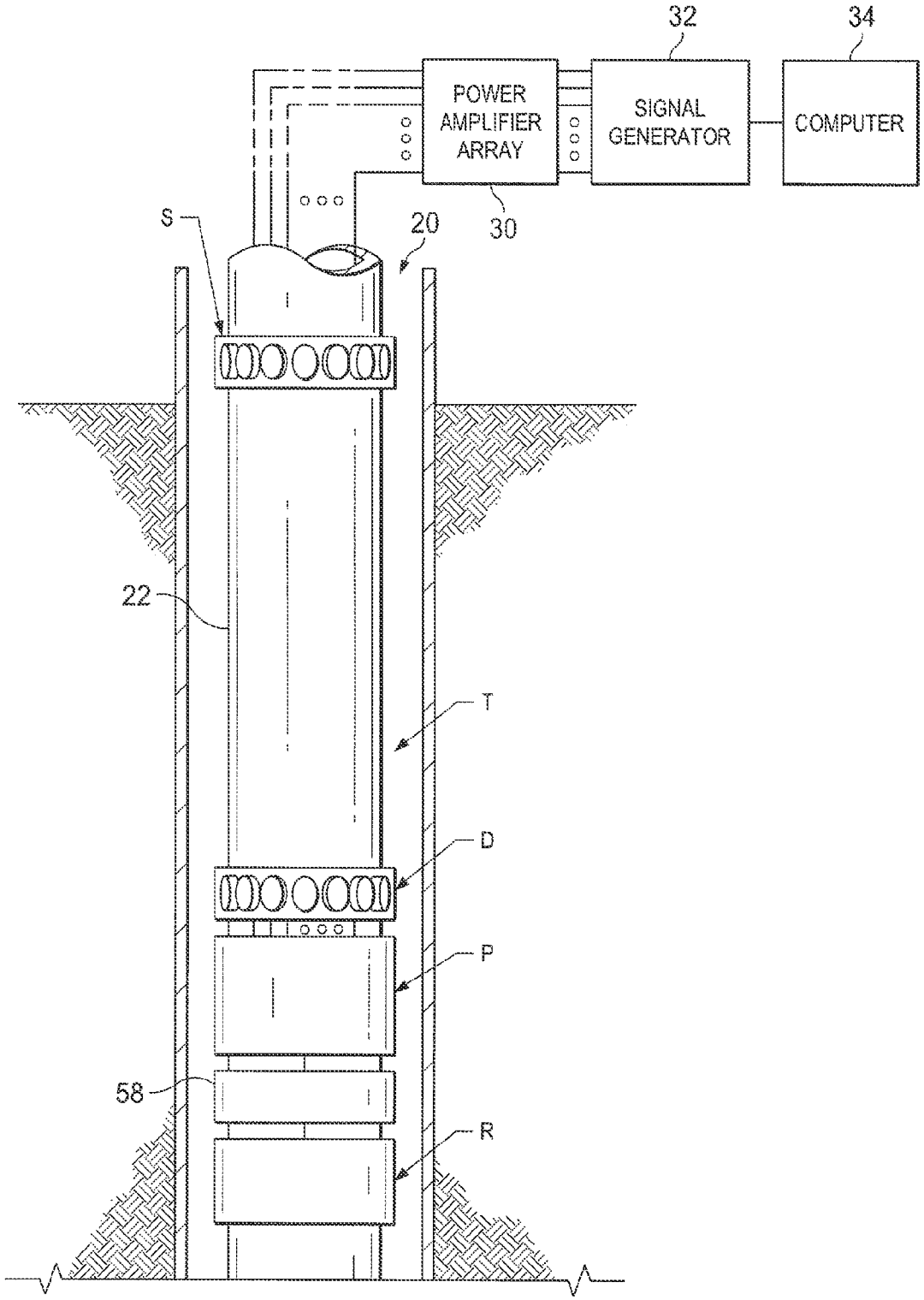
FIG. 11 is a schematic diagram of a modified embodiment of the apparatus of FIGS. 1 and 9.

The output voltage at voltage adder 46 has a varying amplitude and a DC-DC converter 48 charges a downhole power storage device 50 of electrical power/energy storage unit S at a constant voltage. A low-dropout regulator (LDO) is used as a DC-DC converter 48 to convert varying voltage adder output to a clean, or low noise, and constant output voltage. A suitable low-dropout regulator for converter 48 with the present invention is, for example of the type described in Paul Horowitz and Winfield Hill (1989). The Art of Electronics. Cambridge University Press. pp. 343-349. ISBN 978-0-521-37095-0 and Jim Williams (Mar. 1, 1989). "High Efficiency Linear Regulators". Low dropout regulators of this type are capable of operation with a very small input-output differential voltage. Also, other advantages of such a low-dropout regulator as a DC-DC converter include a lower minimum operating voltage, higher efficiency operation and lower heat dissipation The downhole power storage device 50 of electrical power/energy storage unit S can take the form of what is known as a super capacitor or electrochemical capacitor, or it may take the form of a rechargeable battery able to operate in a high pressure high temperature downhole environment. The output from electrical power/energy storage unit S is available for use in the downhole well equipment E to operate a downhole sensor module, a downhole control device of downhole equipment E or a downhole telemetry module R (FIG. 11) through an energy management switching module 52. Energy management switching module 52 operates as a switch which is controlled by a low voltage power cutoff module 54.

Low voltage power cutoff module 54 is a voltage sensor which makes sure that power storage in downhole power storage device 50 is charged to a minimum value before it is used to supply power to a sensing/control module 58 (FIG. 9) of downhole well equipment E. Low voltage power cutoff module 54 also cuts off the power storage device connection from power storage device 50 with the sensing/control module of downhole well equipment E when output power available from power storage device 50 falls below a certain value. Thus the energy management switching module 52 and low voltage power cutoff module 54 make sure that power storage device 50 is connected to downhole sensing/control module 58 or a downhole telemetry module R only when the power storage device 50 has sufficient power stored in it, and cuts off the connection otherwise.

Beamforming

The array of acoustic transmitter transducers 26 in module S is coupled with tubular conduit T and used to send a highly directional, guided acoustic Lamb wave in the tubular conduit T along the wellbore 20. The acoustic transmitters 26 are operated such that specific guided wave modes are excited with a phase velocity that strongly depends on the wall thickness of the tubular conduit T.

A phenomenon known in physics as dispersion describes the property of waves that propagate at velocities that change with frequency. Dispersion curves show the relationship between changes in velocity with frequency. To avoid using dispersive acoustic waves, the frequency of the wave mode of the transmitted guided acoustic Lamb waves is selected such that the velocity is on a constant level or flat part of the dispersion curve. Dispersion curves are calculated and plotted for various conduits T based on the diameter of the conduit and thickness of the conduit wall. An example of dispersion curves for tubular conduits is located at: http://www.twi.co.uk/news-events/bulletin/archive/2008/november-december/corrosion-detection-in-offshore-risersusing-guided-ultrasonic-waves/.

A beam forming technique is used to generate a highly directional, high power and guided acoustic Lamb wave signal along the conduit. Beamforming is a technique used in phased sensor arrays for directional signal transmission or reception. To change the directionality of the array when transmitting, a beam former controls the phase, timing delay and relative amplitude of the signal at each transmitter, in order to create a pattern of constructive and destructive interference in the wavefront. Thus a directional and high power signal can be formed, with improved signal strength and transmission distance. The transmission operation and beamforming is optimized according to the physical dimensions (diameter, wall thickness) for a specific conduit.

The acoustic transmitter array of transducers 26 in module S is a phased array where each transmitter transducer is individually controlled by changing phase, amplitude and timing of the excitation signal with the signal generator 32 under control of computer 34. Beamforming is achieved by applying time delays to the excitation signal sent to each transmitter transducer 26 in the array of module S to focus the transmitted energy in a specific direction.

Figure 6:
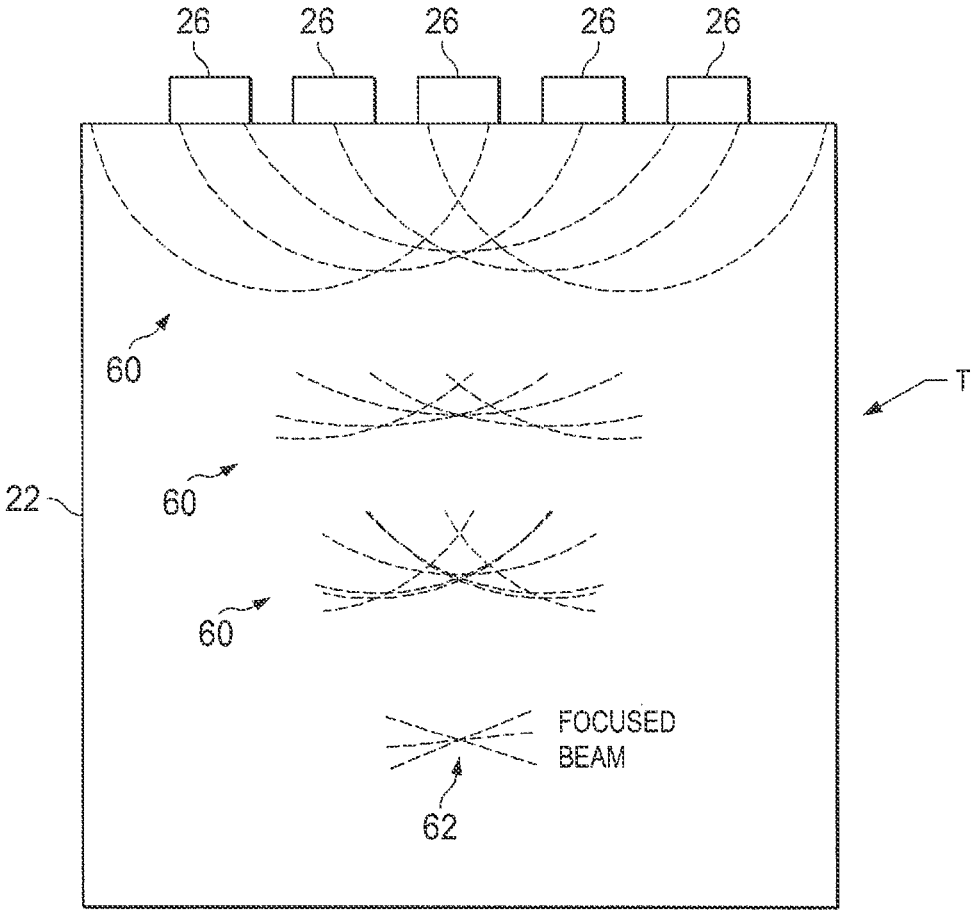
FIG. 6 is a schematic diagram of beam forming in wireless power transmission to downhole well equipment according to the present invention.

As shown schematically at 60 in FIG. 6, the transmitted energy travels as Lamb waves in the walls of tubular conduit T. In FIG. 6, the tubular conduit is shown schematically as a flat plate, and the transmitter transducers 26 are illustrated schematically along upper portions of the flat depiction of conduit T.

Figure 7:
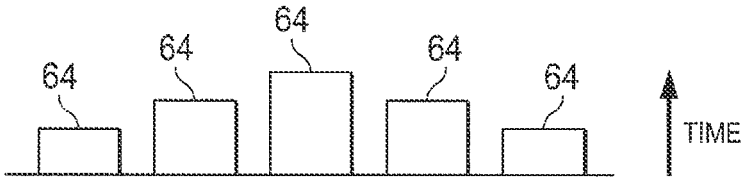
FIG. 7 is a schematic diagram of time delays applied in connection with the beam forming illustrated in FIG. 6.

Delayed versions of the excitation signal are generated by the signal generator 32 under control of computer 34 and applied to adjacent transmitter transducers 26 in the array in such a way that a directional acoustic beam is generated by each of the transducers 26 to travel along the tubular conduit T through its cylindrical walls to arrive as a focused beam 62. FIG. 7 illustrates schematically in bar graph form the amount of time delays 64 for the different individual transmitter transducers 26 illustrated in FIG. 6.

Thus the acoustic signals transmitted by separate transmitters are coordinated to combine constructively and produce the single focused beam acoustic signal 62 (FIG. 6) of larger amplitude. By precisely controlling the delays between the signals of acoustic transmitter transducers 26, beams of various angles, focal distance, and focal spot size are produced. A beamforming technique such as, for example, delay-and-sum can be implemented inside the surface computer 34. It should be understood that other beamforming techniques may also be used.

Operation

As an example, the number of acoustic transmitters 26 in the array of module S is 32. It should be understood that this number can vary according to dimensions of transmission medium. Beam forming is applied on each consecutive group of four such transmitter transducers. Again this number can vary. This means that each group of four consecutive transmitter transducers 26 is operated so that a single directional beam of acoustic guided Lamb wave from that group. Thus a total of eight beams of guided acoustic Lamb waves are in this example transmitted to travel vertically downward along the tubular conduit T.

Although the transmitted guided acoustic Lamb waves are in the form of narrow beams, the beams disperse since they travel very large distances in the wellbore 20 along the tubular conduit T. The acoustic circular receiver array of module D in the wellbore 20 at the desired location in the wellbore 20 senses the beams of the transmitted guided acoustic Lamb waves. Acoustic receiver transducers 28 in the acoustic receiver array of module D operate over the same frequency range (about 100 to about 5000 Hz) as acoustic transmitter array in module S. Acoustic signals received by all of the acoustic receiver transducers 28 in the module D, which are then converted into alternating current (AC) voltage signals in the manner described above. The AC voltage at each acoustic receiver transducer 28 is converted to DC voltage using an associated voltage multiplier in the voltage multiplier array 40. The DC output voltage amplitude at each multiplier in array 40 is different, depending upon the amplitude of acoustic signal received by the receiver transducers 28. The DC voltages at the group of multipliers in array 40 are added together using the voltage adder 44. The output voltage from DC-DC converter 48 charges the downhole power storage device 50 from which power is thus available for use in the downhole well equipment E.

Multiple Transmitter Arrays

Figure 8:
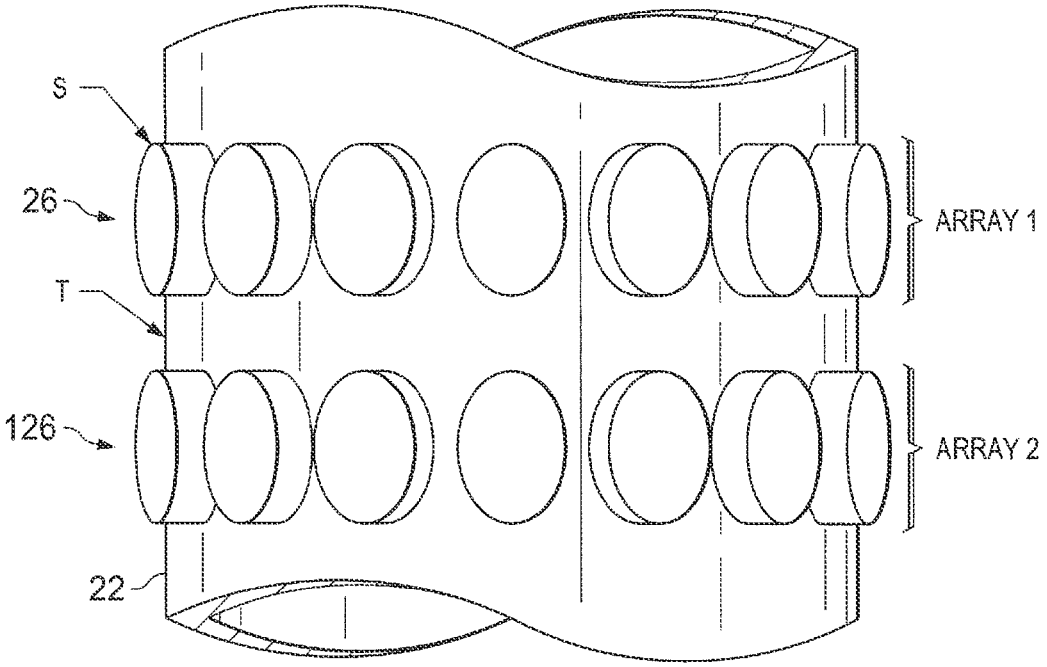
FIG. 8 is a schematic diagram to an alternative embodiment of the structure shown in FIG. 2.

In another embodiment of the present invention, multiple vertically spaced acoustic phased transmitter arrays of acoustic transmitter transducers 26 and 126 (FIG. 8) are provided in the module S. The acoustic transmitter transducers 26 and 126 are coupled with the tubular conduit T and are used to improve the amount of power to be transferred along the wellbore 20 for operation of the downhole equipment E. Although two such arrays are shown in FIG. 8, it should be understood that more than two such arrays may be provided. Multiple phased transmitter arrays can thus be used with circular arrays of transmitter transducers 26 and 126 axially parallel to each other at longitudinally spaced positions on the tubular conduit T as shown in FIG. 8. Beamforming techniques described above are implemented inside the computer 34 to operate transmitter transducers 26 and 126 of the multiple arrays such that phase, timing delay and relative amplitudes of the signal of individual transmitter transducers 26 are controlled, resulting in beamforming and constructive interference of the signals as described above. This increases the amount of power that is transferrable through the tubular conduit T.

Data Modulated Over Power Signal

Figure 10:
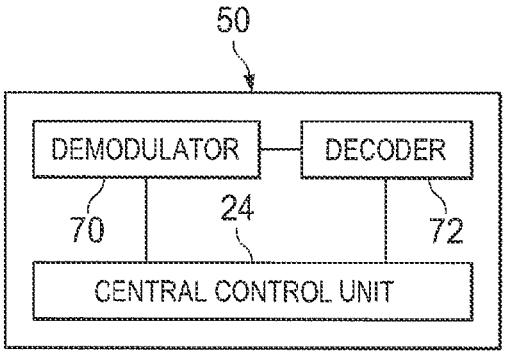
FIG. 10 is a schematic electrical circuit diagram of a portion of the apparatus of FIG. 9.
Figure 9:
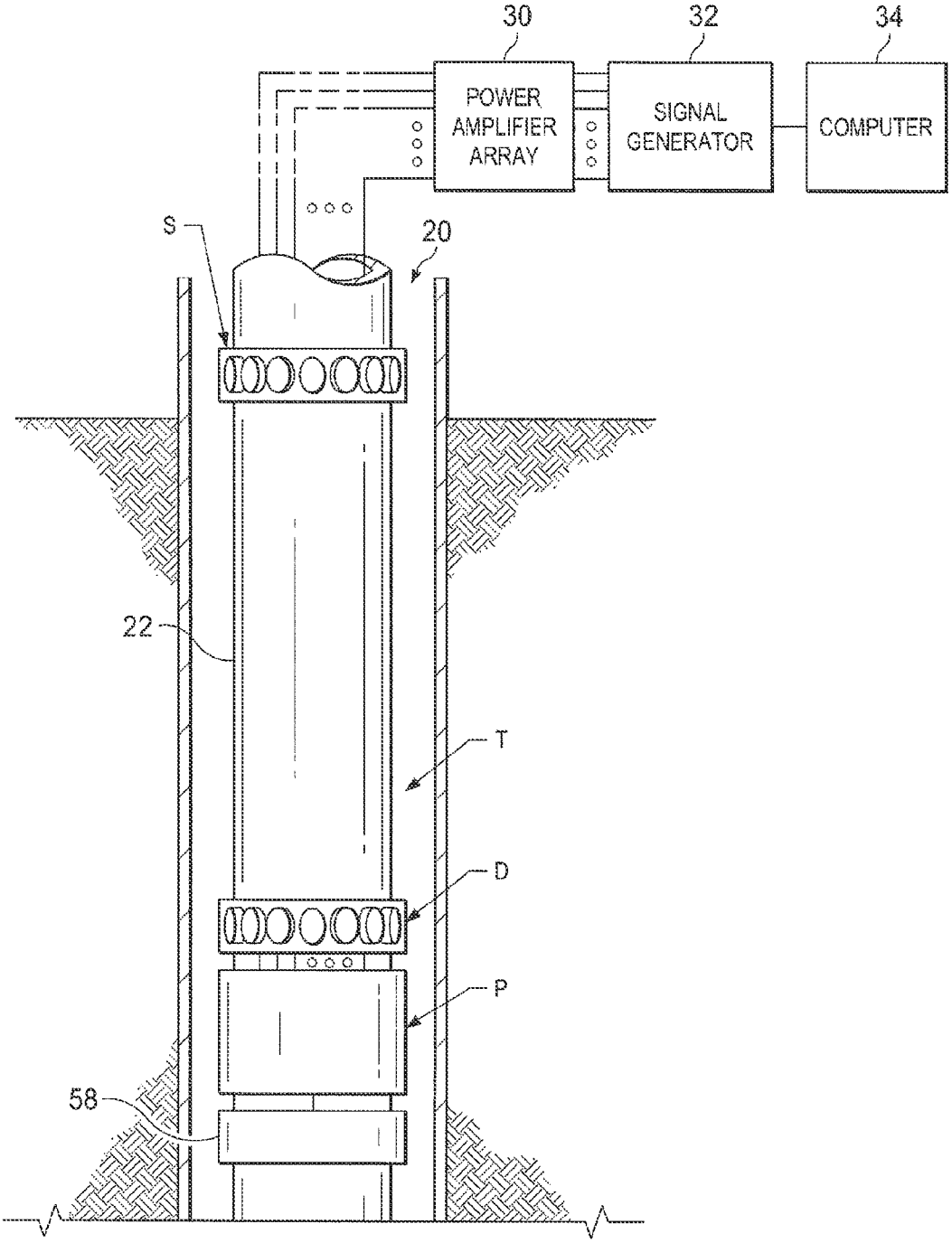
FIG. 9 is a schematic diagram of modified embodiment of the wireless power transmission to downhole well equipment apparatus of FIG. 1.

In another embodiment of the present invention (FIG. 9), a data signal can be modulated over the continuous acoustic guided Lamb wave power waveforms. Thus data and power both can be transmitted along the wellbore. The data signal can include commands and control signals for downhole sensors and control devices. In the embodiment of FIG. 9, a low power control module 58 is also included in the downhole installation on the tubing T. As shown in FIG. 10, the control module 58 includes a demodulator 70, decoder 72 and a central control unit 74. The data can also be transmitted from downhole to surface if a signal generator 32 and a power amplifier array 30 like those shown at the surface are also included in the downhole equipment.

The data can be modulated in digital form with a simple ON-OFF Keying (OOK) modulation technique, where a continuous power signal represents a one '1' and no signal represents a zero '0'. Data is only transmitted to the surface when sufficient power is in downhole storage in power storage device 50. A more sophisticated modulation technique such as Frequency Shift Keying (FSK) or Quadrature Amplitude Modulation (QAM) can also be used to improve data transmission efficiency, but this would make demodulator 70 and decoder 72 implementation more complex. The demodulated data is received at the surface and decoded, for example, by an ultra-low power microcontroller.

Downhole Telemetry

In another embodiment of the present invention, a telemetry module R (FIG. 1) is included in downhole installation of apparatus A otherwise like that shown in FIG. 1 or FIG. 9 to transmit well data sensed by sensors of the downhole equipment back to surface for recordation and evaluation. A number of conventional telemetry techniques may be used in the telemetry module T for wireless telemetry systems based on acoustic and/or electromagnetic communications. A number of conventional acoustical and/or electromagnetic wireless borehole telemetry systems may be used according to the present invention.

Acoustic based examples are contained in the following patents: U.S. Pat. No. 5,050,132; U.S. Pat. No. 5,124,953; U.S. Pat. No. 5,128,901; U.S. Pat. No. 5,148,408; U.S. Pat. No. 5,995,449; U.S. Pat. No. 5,293,937. Some examples of EM based methods include U.S. Pat. No. 6,272,916; and U.S. Pat. No. 5,941,307.

From the foregoing it can be seen that the present invention improves the range and efficiency of wireless power transmission for downhole installations. The present invention provides the capability to transmit power to electrically powered downhole oil equipment or devices which may be sensors (such as pressure, temperature, and multiphase flow meters), flow control mechanisms, and actuators or valves, such as inflow control (ICV's).

The availability of wireless powered devices simplifies the complexity of installation and reduces the operational costs associated with installation and retrieval of such devices. Also the present invention avoid problems presented with use of power transfer cables in wellbores such as reliability issues, complicated installation procedures and risks of cable breaking caused by corrosion as well as heavy wear due to movement of tubing string within the wellbore.

The present invention with guided acoustic Lamb waves provides advantages such as absorption of the waves in the conduit material being low due to the low frequencies used for the Lamb waves. Also, leakage of the Lamb waves out of the conduit should be low because of the high acoustic impedance mismatch at the conduit-fluid boundaries in the wellbore. Substantial portions of the energy should propagate down the conduit with little attenuation of the energy density.

With the present invention, for deeper wells when the transmission distance is longer, the efficiency of acoustic energy transfer is higher than for electromagnetic power transmission. For given dimensions of transmitter and receiver, a guided acoustic Lamb wave based system should require a much lower transmission frequency with high directionality as compared to an electromagnetic based system. Thus guided acoustic Lamb wave based systems can provide high directionality of power transfer, larger transmission distance and small system dimensions.

The invention has been sufficiently described so that a person with average knowledge in the matter may reproduce and obtain the results mentioned in the invention herein Nonetheless, any skilled person in the field of technique, subject of the invention herein, may carry out modifications not described in the request herein, to apply these modifications to a determined structure, or in the manufacturing process of the same, requires the claimed matter in the following claims; such structures shall be covered within the scope of the invention.

It should be noted and understood that there can be improvements and modifications made of the present invention described in detail above without departing from the spirit or scope of the invention as set forth in the accompanying claims.

What is claimed is:

1. An apparatus for wireless transmission of power from a wellhead through walls of well tubing in a wellbore to downhole electrical equipment mounted with the well tubing, comprising:

(a) a transducer module mounted with the well tubing at the surface and converting electrical power to guided wave energy for transfer of the guided wave energy to the well tubing for downhole travel through the walls of the well tubing;

(b) a motion sensing module mounted with the well tubing in the wellbore at a depth in the wellbore of the electrical equipment and sensing the guided wave energy in the walls of the well tubing;

(c) a power converter mounted with the well tubing in the wellbore at the depth in the wellbore of the electrical equipment converting the sensed guided wave energy to electrical energy; and (d) an electrical power storage unit mounted with the well tubing at the depth in the wellbore of the electrical equipment to store electrical energy converted from the sensed guided wave energy.

2. The apparatus of claim 1, wherein the guided wave energy comprises guided acoustic Lamb wave energy.

3. The apparatus of claim 1, wherein the downhole electrical equipment comprises sensors acquiring data from reservoir formations of interest.

4. The apparatus of claim 1, wherein the downhole electrical equipment comprises flow control mechanisms.

5. The apparatus of claim 1, further including a power conditioning circuit conditioning electrical energy received from the power converter for storage in the power storage unit.

6. The apparatus of claim 1, wherein the power storage unit comprises a capacitor.

7. The apparatus of claim 1, wherein the power storage unit comprises a rechargeable battery.

8. The apparatus of claim 1, further including a data modulator applying data signals on the guided wave energy transferred to the well tubing.

9. The apparatus of claim 1, wherein the transducer module comprises a circular array of acoustic transmitter transducers coupled with the well tubing.

10. The apparatus of claim 1, wherein the transducer module comprises a plurality of axially disposed circular arrays of acoustic transmitter transducers coupled with the well tubing.

11. The apparatus of claim 1, further including a telemetry module mounted with the downhole electrical equipment for transmitting data to the surface.

12. A method of wireless transmission of power from a wellhead through walls of well tubing in a wellbore to downhole electrical equipment mounted with the well tubing, comprising the steps of (a) converting electrical power to guided wave energy at the wellhead adjacent the wellbore;

(b) transferring the guided wave energy at the wellhead to walls of the well tubing;

(c) conducting the guided wave energy through the walls of the well tubing for the downhole electrical equipment;

(d) sensing the guided wave energy in the walls of the well tubing at a depth in the wellbore of the downhole electrical equipment;

(e) converting the sensed guided wave energy to electrical energy; and (f) storing the electrical energy converted from the sensed guided wave energy for use as operating power by the downhole electrical equipment.

13. The method of claim 12, wherein the step of transferring guided wave energy comprises the step of transferring guided acoustic Lamb wave energy.

14. The method of claim 12, wherein the downhole electrical equipment comprises sensors acquiring data from reservoir formations of interest.

15. The method of claim 14, further including the step of transmitting telemetry data from the downhole sensors to the surface.

16. The method of claim 12, wherein the downhole electrical equipment comprises flow control mechanisms.

17. The method of claim 12, further including the step of conditioning electrical energy received from the power converter for storage in the power storage unit.

18. The method of claim 12, wherein the step of storing the electrical energy comprises storing the electrical energy in a capacitor.

19. The method of claim 12, wherein the step of storing the electrical energy comprises storing the electrical energy in a rechargeable battery.

20. The method of claim 12, further including the step of modulating data signals on the guided wave energy transferred to the well tubing.

21. The apparatus of claim 1, wherein the guided wave energy comprises elastic motion energy travelling in the walls of the well tubing.

22. The apparatus of claim 1, wherein the guided wave energy comprises elastic motion energy travelling in the walls of the well tubing and guided by the geometry and dimensions of the well tubing.

23. The apparatus of claim 1, wherein the transducer module comprises a phased array or transmitter transducers controlled by an excitation signal to send a directional guided wave as the guided wave energy through the walls of the well tubing.

24. The method of claim 12, wherein the guided wave energy comprises elastic motion energy travelling in the walls of the well tubing.

25. The method of claim 12, wherein the guided wave energy comprises elastic motion energy travelling in the walls of the well tubing and guided by the geometry and dimensions of the well tubing.

26. The method of claim 12, wherein the step of transferring the guided wave energy comprises the step of applying an excitation signal to control the transfer of the guided wave energy as a directional guided wave through the walls of the well tubing.

27. The apparatus of claim 1, wherein the transducer module converts the electrical power to guided wave energy in the form of guided wave energy which travels as particle motion in the cylindrical walls of the well tubing in a vertical plane parallel with the longitudinal axis of the well tubing.

28. The method of claim 12, wherein the step of conducting the guided wave energy through the walls of the well tubing for the downhole electrical equipment comprises the step of conducting the guided wave energy in the form of guided wave energy which travels as particle motion in the cylindrical walls of the well tubing in a vertical plane parallel with the longitudinal axis of the well tubing.

* * * * *